United States Patent [19]

Tanaka

[11] 3,982,387

[45] Sept. 28, 1976

[54] SOLID STATE ELECTRONIC TIMEPIECE

[75] Inventor: Kojiro Tanaka, Yachiyo, Japan

[73] Assignee: Kabushiki Kaisha Daini Seikosha, Japan

[22] Filed: Dec. 24, 1974

[21] Appl. No.: 536,106

[30] Foreign Application Priority Data

Dec. 25, 1973 Japan ..... 49-3971

[52] U.S. Cl. ..... 58/50 R; 58/58; 58/4 A

[51] Int. Cl.[2] ..... G04B 19/30

[58] Field of Search ..... 58/4 A, 50 R, 58 R

[56] References Cited

UNITED STATES PATENTS

| | | | |
|---|---|---|---|
| 3,540,209 | 11/1970 | Zatsky | 58/50 R |
| 3,738,099 | 6/1973 | Tanaka | 58/58 |
| 3,754,392 | 8/1973 | Daniels | 58/50 R |
| 3,889,458 | 6/1975 | Kasho | 58/4 A |

*Primary Examiner*—L. T. Hix
*Assistant Examiner*—Vit W. Miska
*Attorney, Agent, or Firm*—Robert E. Burns; Emmanuel J. Lobato; Bruce L. Adams

[57] ABSTRACT

A solid state electronic timepiece has a second time display section comprised of a plurality of second display elements disposed on the surface of the watch face. The display elements are energized in sequence in a certain time interval so that the elapsed time is recognized by watching the sequential shift of the display pattern in combination with flashing, continuous lighting and lights out modes of energization of the second display elements.

8 Claims, 30 Drawing Figures

| | 41 | 42 | 43 | 44 | 45 | 46 |
|---|---|---|---|---|---|---|
| 0 ~ 9 SECONDS | ✳ | — | — | — | — | — |
| 10 ~ 19 | — | ✳ | — | — | — | — |
| 20 ~ 29 | — | — | ✳ | — | — | — |
| 30 ~ 39 | — | — | — | ✳ | — | — |
| 40 ~ 49 | — | — | — | — | ✳ | — |
| 50 ~ 59 | — | — | — | — | — | ✳ |

| | 41 | 42 | 43 | 44 | 45 | 46 |
|---|---|---|---|---|---|---|
| 0 ~ 9 SECONDS | — | ✳ | ✳ | ✳ | ✳ | ✳ |
| 10 ~ 19 | ✳ | — | ✳ | ✳ | ✳ | ✳ |
| 20 ~ 29 | ✳ | ✳ | — | ✳ | ✳ | ✳ |
| 30 ~ 39 | ✳ | ✳ | ✳ | — | ✳ | ✳ |
| 40 ~ 49 | ✳ | ✳ | ✳ | ✳ | — | ✳ |
| 50 ~ 59 | ✳ | ✳ | ✳ | ✳ | ✳ | — |

SOLID STATE ELECTRONIC TIMEPIECE

BACKGROUND OF THE INVENTION

This invention relates to a solid state electronic timepiece having a plurality of display sections which are composed of electro-optical display devices such as liquid crystal material or light emitting diodes, etc,.

In conventional types of solid state digital electronic watches, having a second indicating device on one face of the watch, said second indicating device usually lights at only one particular second which is determined by the operation of a push switch.

Another type of digital watch displays the time of hour, minutes and second by numerals on one surface of the watch. In the former watch, it is impossible to know the elapsed time of seconds, because said second indicating device lights during only one second so that it indicates only when activated. In the latter watch, it is very difficult to read the indicated second display because, said second display changes too fast and it is not clear to see the display element composed of liquid crystal material as the response of liquid crystal is rather slow.

The display mechanism devices used in conventional type watches are inadequate for use in electronic solid state watches.

OBJECT OF THE INVENTION

The present invention aims at eliminating the above noted difficulty and insufficiency, and therefore it is the primary object of the present invention to provide an electronic solid state timepiece capable of displaying at least a certain elapsed time in seconds by the sequential shift of energization of the display on the face of the timepiece.

It is another object of the present invention to provide a new timepiece from the standpoint of design.

SUMMARY OF THE INVENTION

According to the present invention, there is provided an electronic solid state timepiece having a plurality of second display elements for display of time in second on the face of said timepiece, said display elements being sequentially energized in predetermined patterns of flashing, continuous lighting and lights out modes.

Furthermore, said display pattern is selected in either one of said fllashing, continuous lighting and lights out modes and the particular mode is sequentially transferred from one display element to another display element so that the elapsed time in second can be ascertained in which after said display function was transferred to another display has another display function against said display function until display function of all said display elements were completely finished.

BRIEF DESCRIPTION OF THE DRAWINGS

The above mentioned and further objects, features and advantages of the present invention will become more apparent from the following description when taken in connection with the accompanying drawings, which shown preferred embodiments of the invention, and wherein.

DETAILED DESCRIPTION OF THE INVENTION

Referring now to the accompanying drawings, one embodiment of this invention is explained and this embodiment directed to a range of second indication, but needless to say it is not restricted to said second indication.

Figure 1:
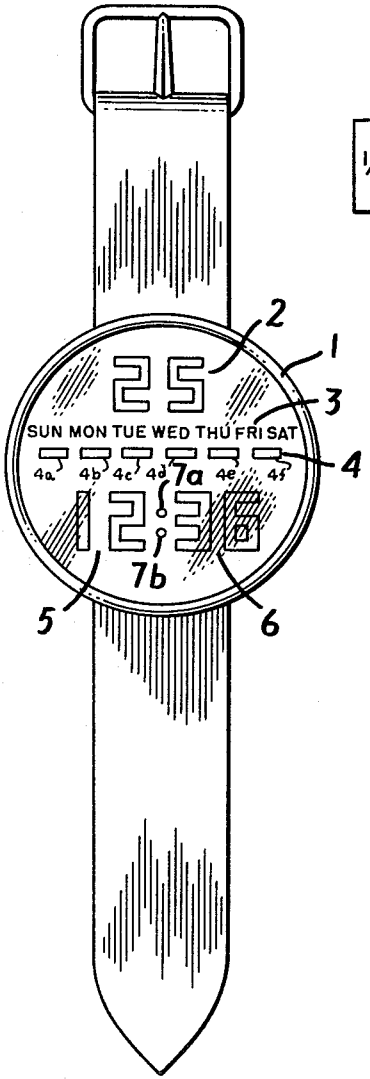
FIG. 1 is a front plan view for an electronic timepiece made in accordance with present invention.

FIG. 1 shows a front plan view of a digital watch of this invention.

Many kinds of display elements are disposed on the face of the watch body 1, including a date display element 2, a plurality of days of the week display elements 3, a plurality of second display elements 4 positioned beneath said display elements 3, is hour display element 5 and minute display element 6.

Furthermore, there is a pair of point display elements *7a* and *7b* which divide hour display element 5 and minute display element 6 and which denote A.M. or P.M. condition. For example, when one of the point display elements *7a* or *7b* is energized, it displays the A.M. condition, and when both of the point display element *7a* and *7b* are energized, such displays the P.M. condition. The represents only one embodiment and another modification or combination may easily be made.

These display elements comprise electro-optical devices, and the display of hour and minutes is displayed in digitial form and the display of seconds is displayed in analogue form, as explained.

According to this invention, a plurality of second display elements *4a–4f* are disposed on the surface of the watch face, and they are energized in sequence at prescribed time intervals. The display element *4a–4f* display the seconds in analogue form as described hereinafter.

Figure 2:
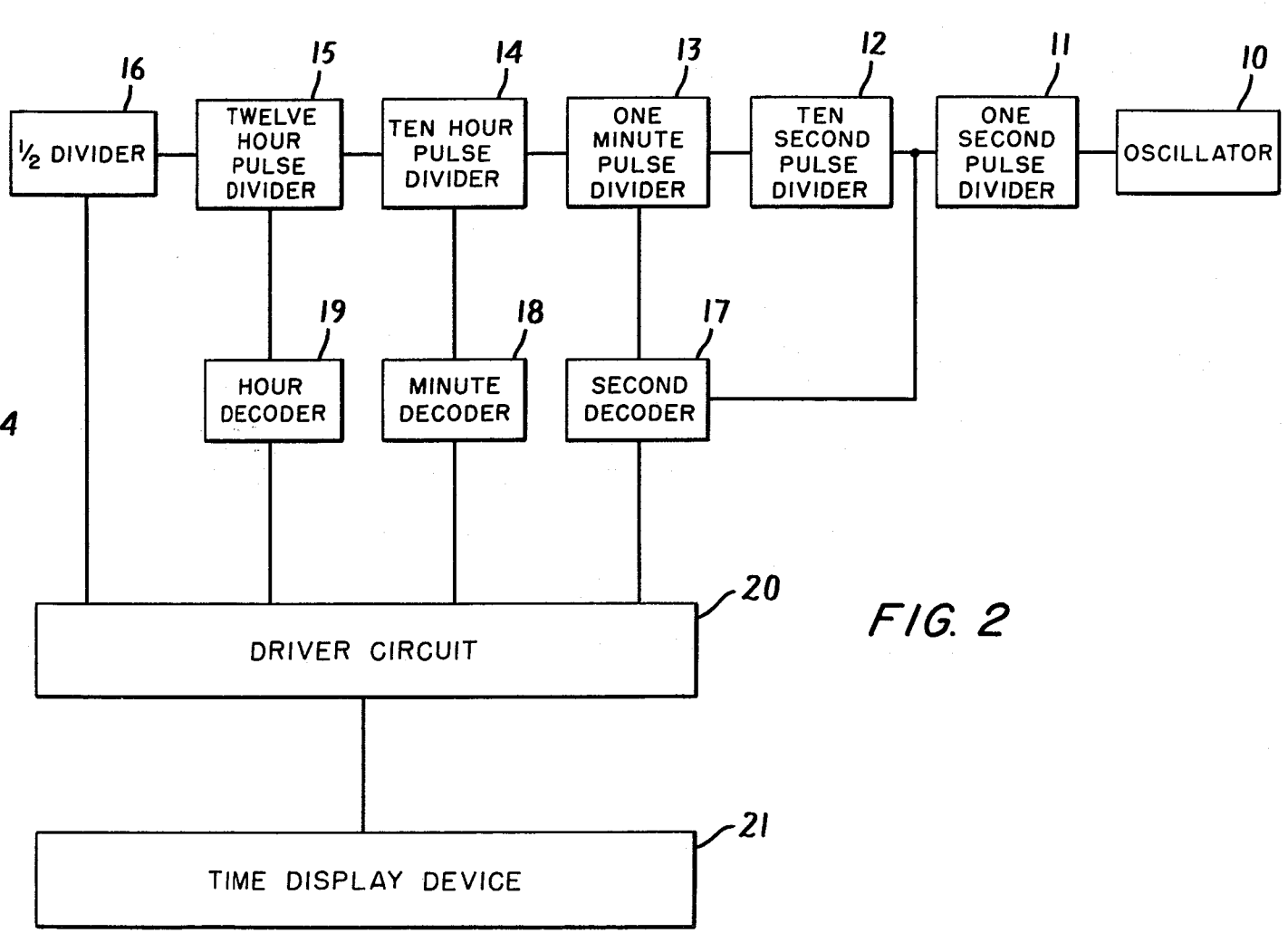
FIG. 2 is a drive block circuit diagram for an electronic timepiece.

FIG. 2 shows a block diagram of the drive circuit of this electronic watch. Oscillator 10 is a quartz crystal oscillator of which oscillating frequency is 32.768 KHz. This oscillating frequency is divided into one second pulses by 1 second pulse divider 11. Said second pulses are divided into ten second pulses by ten second pulse divider 12.

Said 10 second pulses are divided into 1 minute pulse by one minute divider 13, said 1 minute pulses are divided into 1 hour pulses by 1 hour divider 14, said 1 hour pulses are divided into 12 hour pulses by 12 hour pulse divider 15, and said 12 hour pulses are divided into ½ by one-half divider 16. Three decoders 17, 18 and 19 are connected as shown and said 1 minute pulse of divider 13 is put into second decoder 17, said hour pulse of divider 14 is put into minute decoder 18, and said 12 pulse of divider 15 is put into hour decoder 19.

The output signals from said each decoder 17, 18 and 19 and divider 16 are put into a diver circuit 20 for energizing and driving time display device 21. Said divider 16 is utilized for controlling energization of the A.M. and P.M. display.

The manner in which the display elements of the day and days of a week displays are energized is well known in the art and therefore will not be further delineated herein.

Then, according to this invention, the shift-register or ring-counter of said divider 13 is used for controlling energization of the second display, and the second time is displayed by a combination of flashing, continuous lighting and lights out modes of energization of said second display elements effected by the shift-register or ring-counter and decoder 17. For example, the embodiments of this invention are shown from FIG. 3 to FIG. 30, the display of sixty seconds is displayed by using six display elements such as the element 4*a*–4*f* in FIG. 1.

Figure 3:
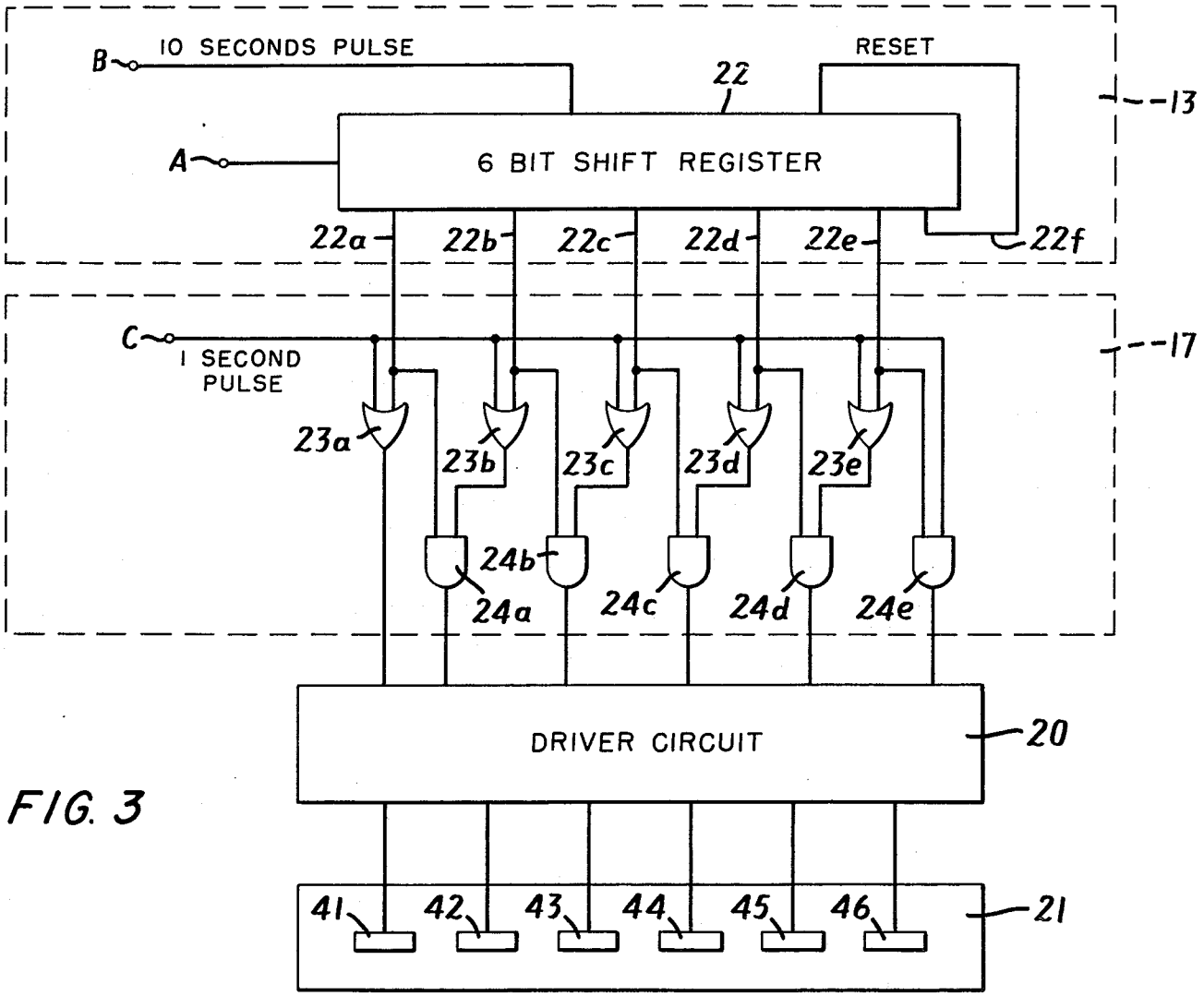
FIG. 3 is a circuit for an additional display.

In FIG. 3, a signal ["1"] (having a certain voltage level) usually from lead line A is usually applied to six bit-shift register 22, and further, a shift pulse from said divider 12 is applied to the six bit-shift-register at 10 seconds intervals via output lead line B. Consequently, after 10 seconds, the register 22 is reset. Said signal ["1"] appears on output lead line 22*a* of shift-register 22, and further said signal ["1"] appears sequentially on output lead line 22*b*, 22*c* — from the left side to the right side in FIG. 3. After 60 seconds have elapsed, said signal ["1"] appears on all output lead lines 22*a* to 22*f*. When said signal ["1"] appears on output lead line 22*f*, all the registers are reset simultaneously.

Said output lead lines 22*a* to 22*e* are connected to decoder 17, which consists of five OR-gates 23*a* to 23*e* and five AND-gates 24*a* to 24*e*.

Said output lead lines 22*a* to 22*e* of said shift register are connected to one side of the input terminals in said OR-gates 23*a* to 23*e*. Common lead line C for applying a one second pulse from divider 11 is connected to another input terminal of said OR-gates 23*a* to 23*e*, and said output lead lines 22*a* to 22*e* of said shift-register 22 is connected to said one input terminal of said AND-gates 24*a* to 24*e*.

Furthermore, all of said OR-gates 23*a* to 23*e* are connected as follows; said output lead line of said OR-gate 23*b* is connected to another input terminal of said AND-gate 24*a*, said output lead line of said OR-gate 23*c* is connected to another input terminal of said AND-gate 24*b*, said output lead line of said OR-gate 23*d* is connected to another input terminal of said AND-gate 24*c*, and said output lead line of said OR-gate 23*e* is connected to another input terminal of said AND-gate 24*d*, and said common lead line C for applying said 1 second pulse ["1"] is connected to said input terminal of said AND-gate 24*e*.

Said output lead line of each AND-gate 24*a* to 24*e* and said output lead lineof OR-gate 23*a* are connected to each said second display elements 41, 42, 43, 44, 45 and 46 respectively via said driver 20 (electronic exciter for power amplification).

Now, in this embodiment of this invention, each of said second display elements 41 to 46 is made of liquid crystal, material which is sandwiched between a pair of glass plates having electrodes thereon. As well known in the art the display is read by changing the reflection percentage of said liquid crystal material in response to excitation by a suitable voltage. But this invention is not restricted to liquid crystal, and may be practiced with light emitting diodes.

In the above electronic circuit of second display, when said signal on output lead lines 22*a* to 22*f* from shift-register 22 is ["1"], said 1 second pulse [1″] is applied to said second display element via said divider 11, said output lead line C of OR-gate 23*a* and driver 20, and the second display element 41 is repeatedly lighted or flashed once every 1 second, for 10 seconds during from zero second to 9 seconds.

After 10 seconds have elapsed, 10 seconds signal [10″] is generated from said divider 12, said 10 seconds signal [10″] is applied to said shift-register 22 via output lead line A, and then applied to OR-gate 23*a* and AND-gate 24*a* via said output lead line 22*a* of said shift-register 22. Accordingly, the output signal of said OR-gate 23*a* is maintained at ["1"], so that said second display element 41 is changed from its flashing mode to a continuously lighting mode.

When said OR-gate 23*b* and AND-gate 24*a* are maintained in the ON-position, said flashing display is transferred to said second display element 42 due to the 1 second pulse on said output lead line C.

In the same manner, said 10 seconds flashing display is successively transferred to said second display elements 43, 44, — 46 in rotation. When the 10 second flashing of said second display elements is finished, said second display elements are maintained in a lighting continuous mode. Furthermore, when said signal ["1"] is applied to the output lead line 22*f* of the end stage in said shift-register 22, the reset operation is attained instantaneously.

Upon resetting of the register 22 said display elements 42 to 46 are deenergized and changed to the lights out, mode and the first display element 41 starts flashing. Then, the sequence of operation in repeated and said second display elements 41 to 46 are flashed in 10 second increments and thereafter maintained continuously lit.

Figure 4:
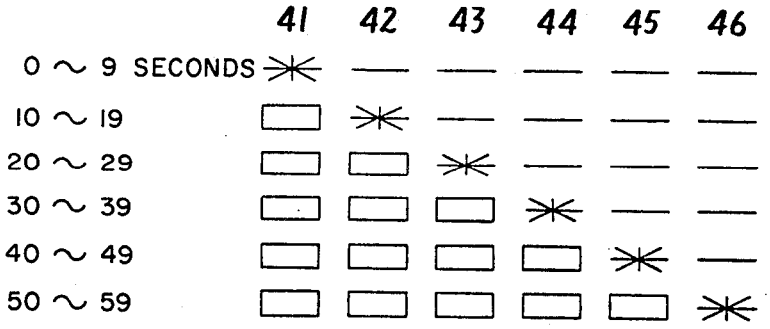
FIG. 4 is a chart showing the display function according to a circuit in FIG. 3.

A chart of the display function is indicated in FIG. 4, and for example to indicate 35 seconds, said second display elements 41 to 43 are maintained in the continuous lighting mode and said second display element 44 is flashing six times at one second intervals, and the second display elements 45 and 46 are maintained in the lights out mode. Sixty seconds display is recognized by said second element 46 flashing ten times.

Throughout the drawings and in FIG. 4, the mark "*" indicates flashing condition, the mark "□" indicates the continuously lighting condition, and the mark "-" indicates lights out condition.

Figure 5:
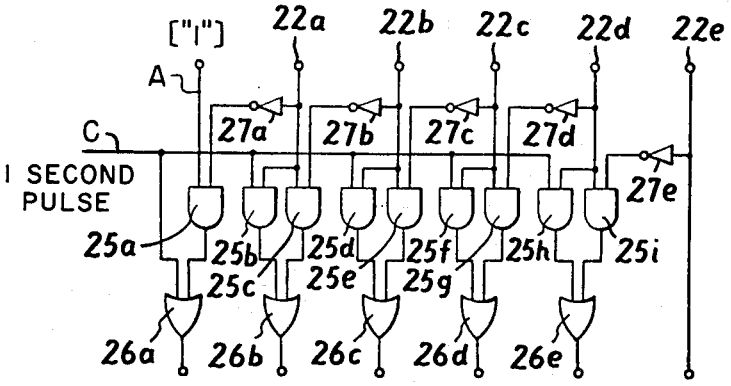
FIGS. 5 to FIG. 30 are circuit diagrams and display function charts of other embodiments of this invention.
Figure 6:
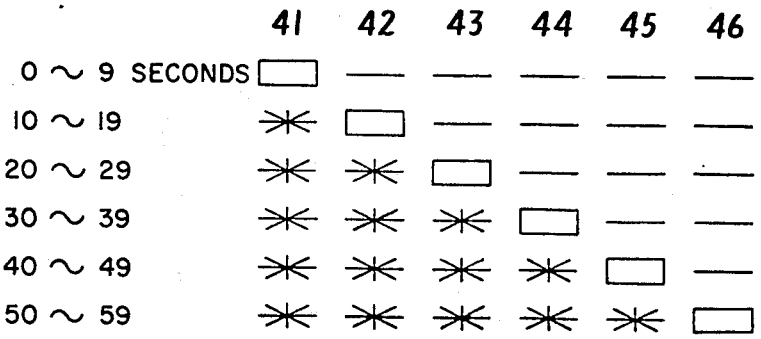

FIG. 5 and FIG. 6 show another embodiment, this embodiment has another display function from the above said display function. The display element is changed from lights out to continuously lighting condition after 10 seconds have elapsed, and furthermore after the 10 seconds have elapsed, said display element is changed from lighting to flashing condition and this flashing condition is maintained. In this case, the decoder 17 is indicated in FIG. 5, and consists of nine parts of AND-gates 25*a* to 25*i*, five parts of OR-gates 26*a* to 26*e* and five parts of inverters 27*a* to 27*e*. These OR-gate, AND-gate and inverter are respectively connected as shown in FIG. 5.

FIG. 6 shows a chart of the display function according to said decoder 17 in FIG. 5.

FIG. 7 to FIG. 14 show another embodiment and another display function by the combination of flashing and lighting.

Figure 7:
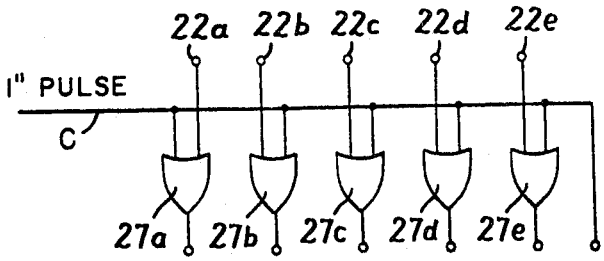
Figure 8:
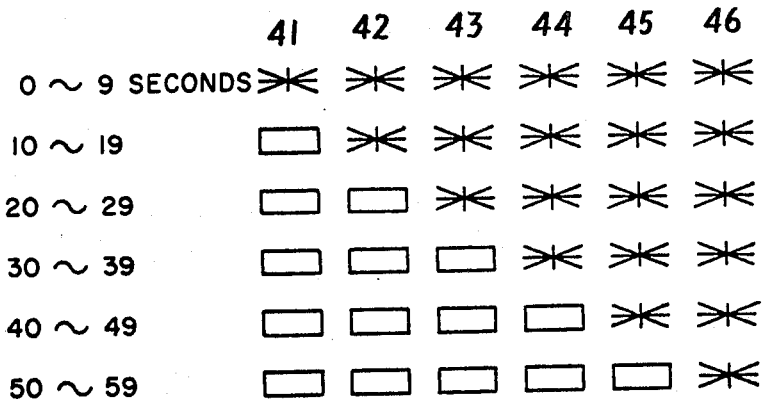

In FIG. 7, the decoder 17 consists of five OR-gates 27*a* to 27*e*, said output lead lines 22*a* to 22*e* of said shift-register 22 are connected to one side input terminal of said OR-gates 27*a* to 27*e* respectively. Said common lead line C for applying one pulse from said divider 11 is connected to another input terminal of each OR-gate 27*a* to 27*e*, said output lead lines of each OR-gate 27*a* to 27*e* are connected to each second display element 41 to 45 respectively via said driver 20. Said common lead line C for applying one second pulse is connected to display element 46, a new display function in FIG. 8 is obtained by the above identified circuit connection.

Figure 9:
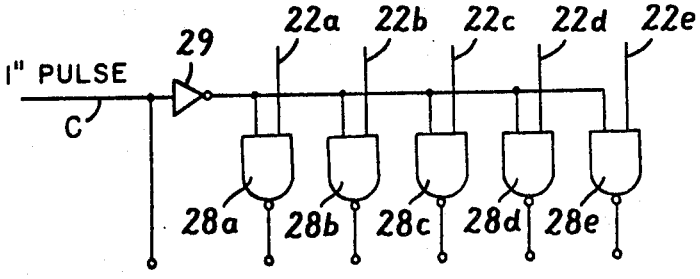

Furthermore, FIG. 9 shows OR-gates 27*a* to 27*e* in FIG. 7 exchanged by NAND-gates 28*a* to 28*e*, and said output lead line C is connected to each input terminal of said each NAND-gate via inverter 29. The chart of the display function using the above circuit in FIG. 9 is indicated in FIG. 10.

Figure 10:
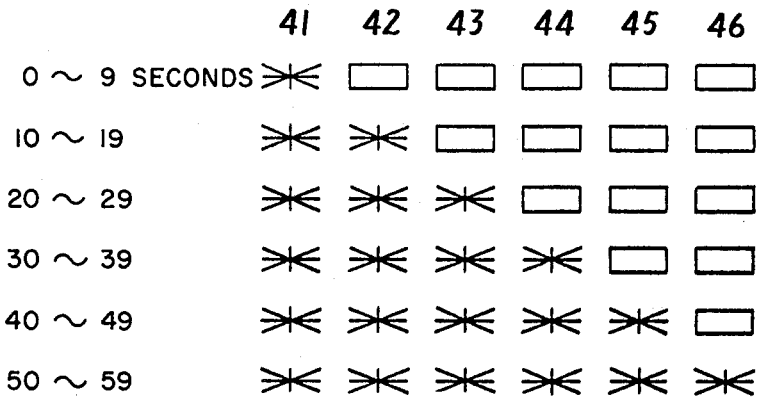

FIG. 10 shows that each said display element transferred from lighting condition to flashing condition in rotation, and the time is displayed by an additional flashing display.

Figure 11:
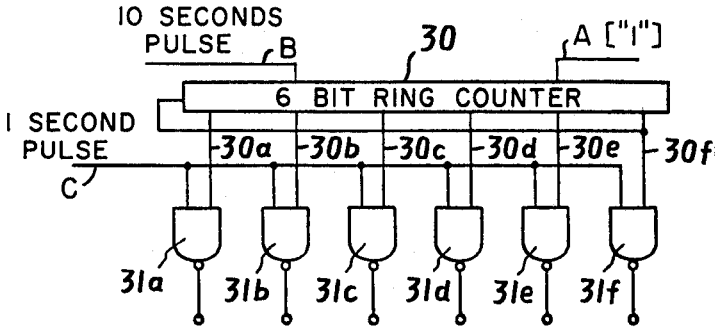
Figure 12:
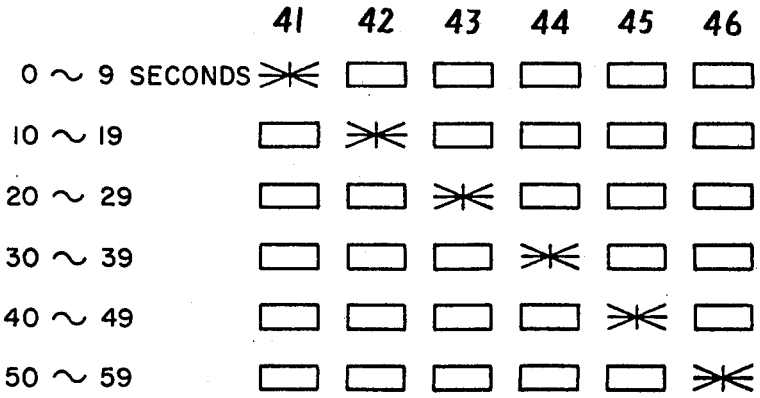

FIG. 11 to FIG. 14 show said shift-register 22 exchanged by a ring-counter 30, and in FIG. 11, said decoder 17 consists of six parts of NAND-gates 31*a* to 31*f*, output lead lines 30*a* to 30*f* and common lead line C for applying one second pulse [1''] are connected to the input terminal of six bit-ring-counter 30. In this display, all display elements are lighted, and then flashing is transferred from display elements 41 to 46 at 10 second intervals in rotation, and a chart of these display functions is shown in FIG. 12.

Figure 13:
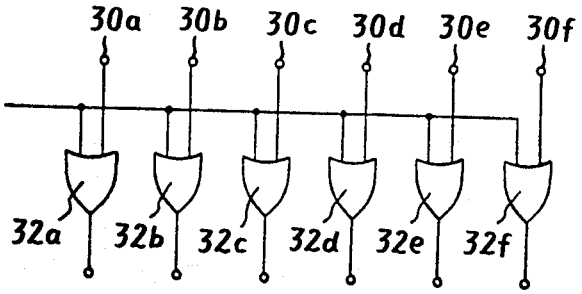
Figure 14:
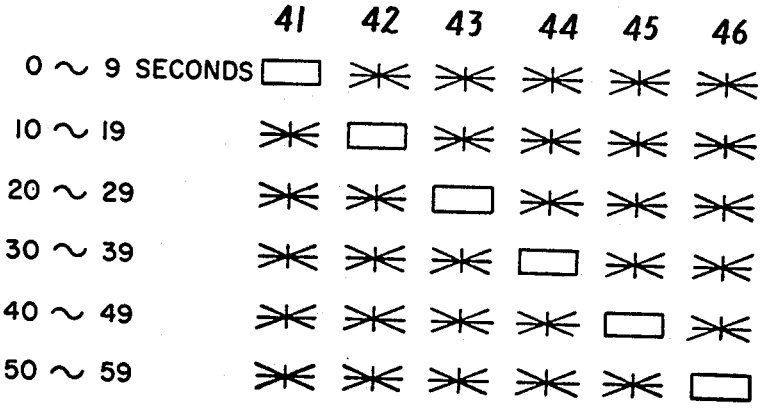

FIG. 13 shows said NAND-gate exchanged by OR-gates 32*a* to 32*f*, and it is displayed in FIG. 14 by using above circuit connection.

Figure 15:
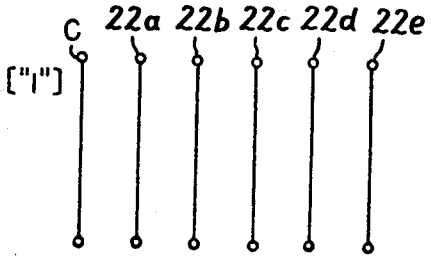
Figure 22:
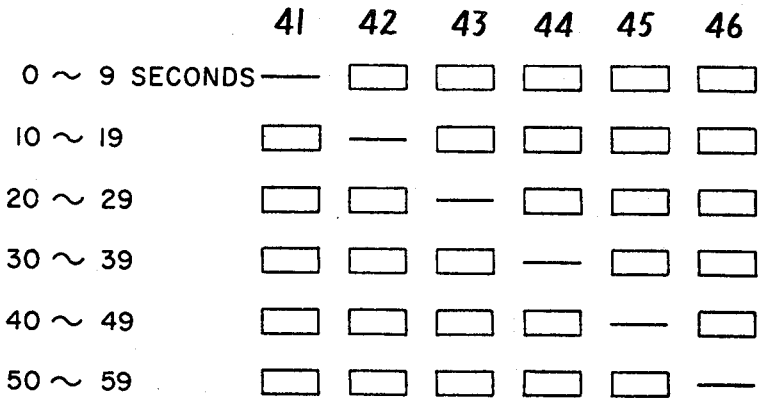
Figure 23:
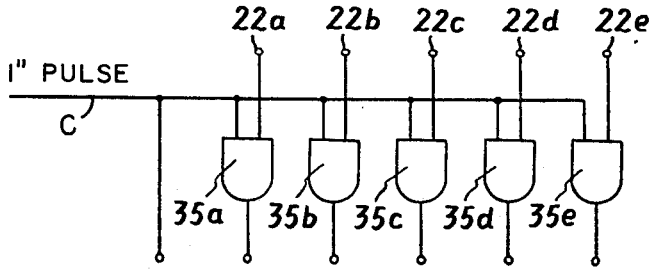
Figure 24:
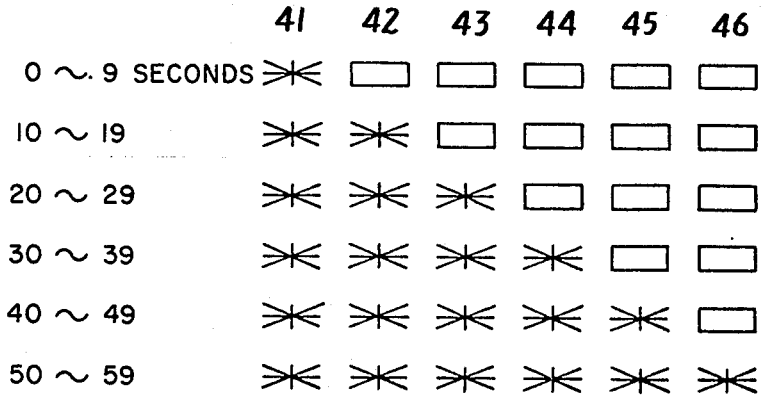
Figure 25:
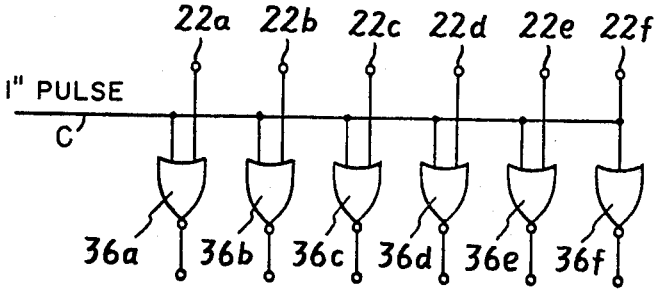
Figure 26:
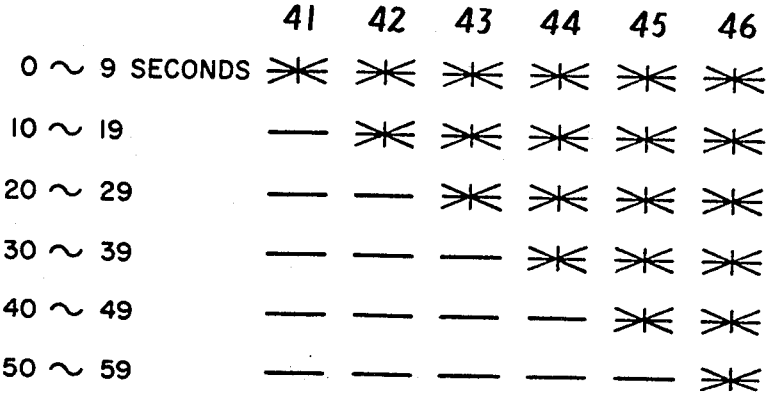
Figure 27:
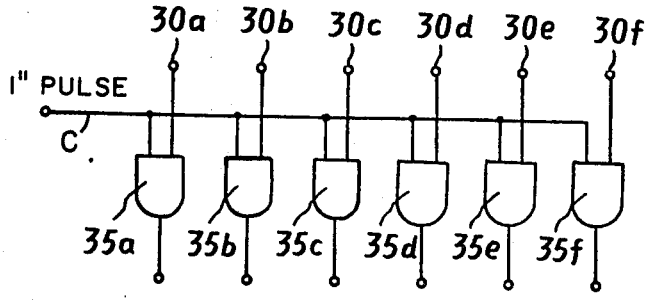
Figures 28, 29, 30:
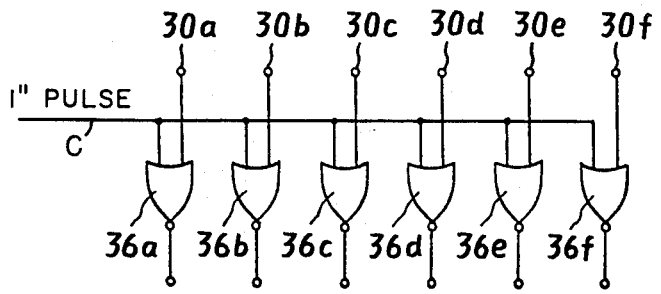

FIG. 15, to FIG. 22 show another embodiments which display in combination of lighting and lights out.

FIG. 15 to FIG. 18 show an example of divider 13 using six bit-shift-register.

Figure 16:
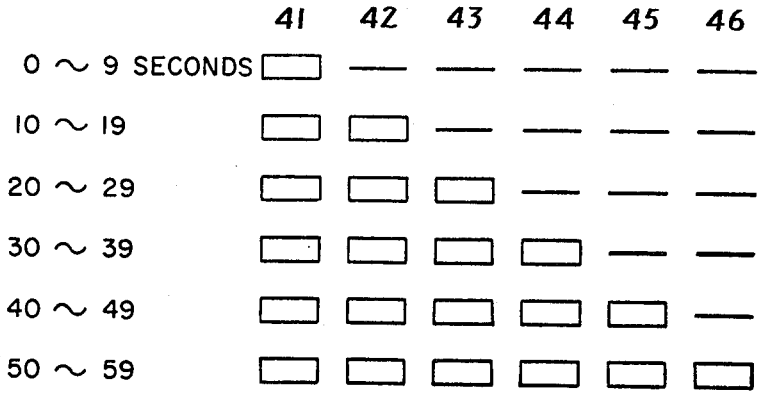

In FIG. 15, output lead 22*a* to 22*e* of said shift-register 22 is connected to said display elements 42 to 46 except said first display element 41, and said signal ["1"] is applied to said first display 41 constantly, and this display function is indicated in FIG. 16, each said display element is additionally energized from lights out to lighting condition in rotation.

Figure 17:
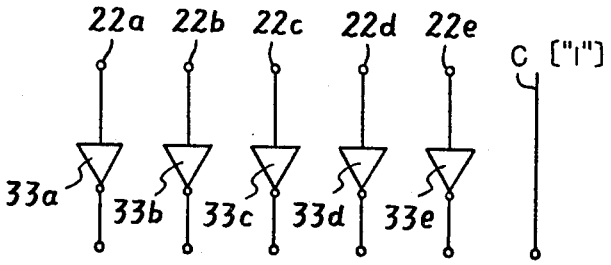
Figure 18:
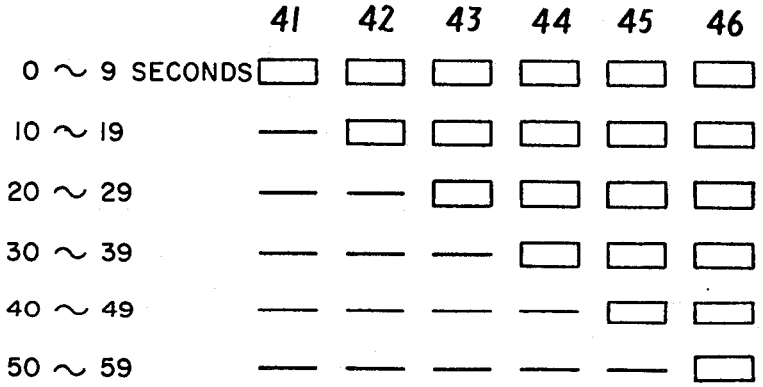

In FIG. 17, said output lead lines 22*a* to 22*e* of said register apply said signal to said each display element via said inverters 33*a* to 33*e* and a chart of this display function using the circuit connection in FIG. 17 is indicated in FIG. 18, said display function having the opposite function as said display in FIG. 16.

FIG. 19 to FIG. 22 show a display function and circuit using said six bit-ring-counter 30 instead of said divider 13.

Figure 19:
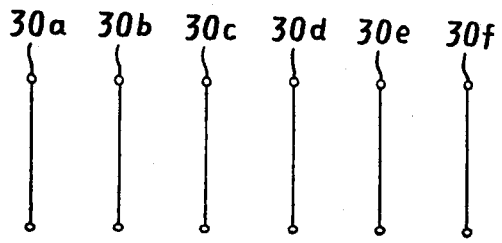
Figure 20:
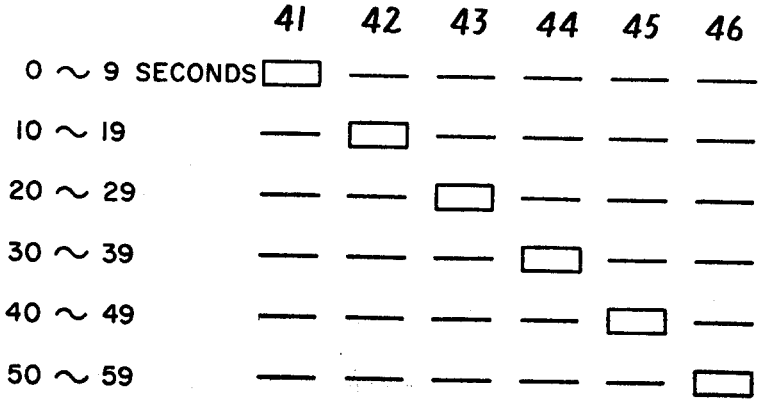
Figure 21:
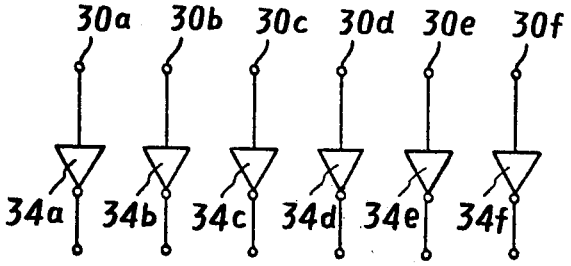

In FIG. 19, output lead lines 30*a* to 30*f* of said six bit-ring-counter 30 are connected to said each display element 41 to 46 via said driver 20, and a chart of the display function in combination with lighting and lights out modes using circuit connection in FIG. 19 is indicated in FIG. 20.

In FIG. 22, the contrary opposite display function as the display in FIG. 20 is indicated by using inverters 34*a* to 34*f*.

FIG. 23 to FIG. 30 show other display function embodiments of this invention, the embodiment using six bit-shift-register instead of said divider 13 is shown in FIG. 23 to FIG. 26, and FIG. 27 to FIG. 30 show in embodiments in using six bit-ring-counter 30 instead of said divider 13 as same as above embodiment.

In these figures, numerals 35*a* to 35*f* indicate AND-gates, and numerals 36*a* to 36*f* indicate NOR-gates respectively.

The present invention thus provides an effective display function in an electronic watch, and this display function is shown by the display change from one display element to another display element in combination with flashing, continuous lighting and lights out modes.

Furthermore, the display change from one display element to another display element in preselected combinations of flashing, continuous lighting and lights out modes is carried out at a constant time interval, and these display functions are more clear than displaying the second range by numeral display of liquid crystal. In addition, it is possible to use liquid crystal material having bad response characteristics as the shape of the symbol is unimportant.

In all the embodiments, the display elements may comprise liquid crystals, such as the DSM (dynamic scattering mode) and FEM (field-effect mode), or other electro-optical elements such as LED (light-emitting diode), EGCL (electro-generated chemical luminescence) or PLZT (ceramic material containing $PbTiO_2$ and $PbZrO_2$).

While there has been shown and described preferred embodiments of the present invention, it will be understood that the same is not restricted thereto but be susceptible of numerous changes and modifications as known to a person skilled in the art, and therefore, it is not intended to limit the invention to the details shown but intended to cover all such changes and modifications as are encompassed by the scope of the appended claims.

What is claimed is:

1. In an electronic timepiece: an oscillator for producing a high frequency time signal suitable as a time standard; means receptive of the time signal for dividing it into at least hour, minute and second drive signals; time display means receptive of the hour and minute drive signals for displaying the time in hours and minutes; and second display means receptive of the second drive signal for continuously displaying an indication of the time in seconds, said second display means comprising six energizable display elements operable when energized to provide a light output, and circuit means responsive to the second drive signal for repeatedly and sequentially energizing said six display elements at ten-second intervals to effet flashing of each display element at one-second increments for a period of ten seconds to obtain a repeating succession of flashing light outputs at one-second increments thereby displaying a continuous indication of the time in seconds.

2. An electronic timepiece according to claim 1, wherein said circuit means includes means operable during every sixty second period for maintaining five of said display elements continuously energized so that each provides a continuous light output upon completion of its ten second flashing light output to thereby indicate during every sixty-second period the elapse of successive ten-second intervals.

3. An electronic timepiece according to claim 1; wherein said time display means comprises hour and minute display sections, and a pair of point display elements disposed between said hour and minute display sections for distinguishing AM and PM.

4. An electronic timepiece according to claim 1; wherein said circuit means includes means operable during every 60-second period for maintaining said display elements continuously energized so that each provides a continuous light output during the time it is not providing a flashing light output.

5. An electronic timepiece according to claim 4; wherein said time display means comprises hour and minute display sections, and a pair of point display elements disposed between said hour and minute display sections for distinguishing AM and PM.

6. In an electronic timepiece: an oscillator for producing a high frequency time signal suitable as a time standard; means receptive of the time signal for dividing it into at least hour, minute and second drive signals; time display means receptive of the hour and minute drive signals for displaying the time in hours and minutes; and second display means receptive of the second drive signal for continuously displaying an indication of the time in seconds, said second display means comprising six energizable display elements operable when energized to provide a light output, and circuit means responsive to the second drive signal for repeatedly and sequentially energizing said six display elements at 10-second intervals during each 60-second period such that said display elements sequentially provide a continuous light output for 10 seconds and thereafter provide a flashing light output at 1-second increments for the remainder of the 60-second period.

7. In an electronic timepiece: an osciallator for producing a high frequency time signal suitable as a time standard; means receptive of the time signal for dividing it into at least hour, minute and second drive signals; time display means receptive of the hour and minute drive signals for displaying the time in hours and minutes; and second display means receptive of the second drive signal for continuously displaying an indication of the time in seconds, said second display means comprising six energizable display elements operable when energized to provide a light output, and circuit means responsive to the second drive signal for repeatedly and sequentially energizing said six display elements at 10-second intervals such that said display elements sequentially provide a continuous light output for 10 seconds and otherwise provide a flashing light output at 1-second increments.

8. An electronic timepiece according to claim 7; wherein said time display means comprises hour and minute display sections, and a pair of point display elements disposed between said hour and minute display sections for distinguishing AM and PM.

* * * * *